United States Patent [19]

Szabo

[11] Patent Number: 5,072,099

[45] Date of Patent: Dec. 10, 1991

[54] CONTAINER COUNTING APPARATUS

[75] Inventor: Richard F. Szabo, Saginaw, Mich.

[73] Assignee: Fischer-Flack, Inc., Saginaw, Mich.

[21] Appl. No.: 401,425

[22] Filed: Aug. 31, 1989

[51] Int. Cl.[5] ..... G06M 7/00

[52] U.S. Cl. ..... 235/98 C; 377/6

[58] Field of Search ..... 235/98 R, 98 C; 221/2; 377/6, 8

[56] References Cited

U.S. PATENT DOCUMENTS

| | | | |
|---|---|---|---|
| 3,881,353 | 5/1975 | Fathauer | 377/6 X |
| 4,562,339 | 12/1985 | Sjogren et al. | 235/98 R |
| 4,590,364 | 5/1986 | McDonald et al. | 235/98 C |

*Primary Examiner*—Benjamin R. Fuller
*Assistant Examiner*—David Yockey
*Attorney, Agent, or Firm*—Learman & McCulloch

[57] ABSTRACT

Apparatus for counting opaque and transparent containers has a movable conveyor which delivers such containers along a path to a discharge zone. The conveyor path is separated by dividers into adjacent lanes and such dividers are of varying height relative to the conveyor. A metering device overlies the conveyor path and is operable to preclude container stacking. A counting mechanism is associated with each of the lanes to count each container that passes the discharge zone. The counting mechanism comprises a sonic sensor having an emitter and a receiver which are angularly arranged in a plane at an angle to the path of container movement through the discharge zone, thereby avoiding linearity between adjacent sonic sensors.

13 Claims, 1 Drawing Sheet

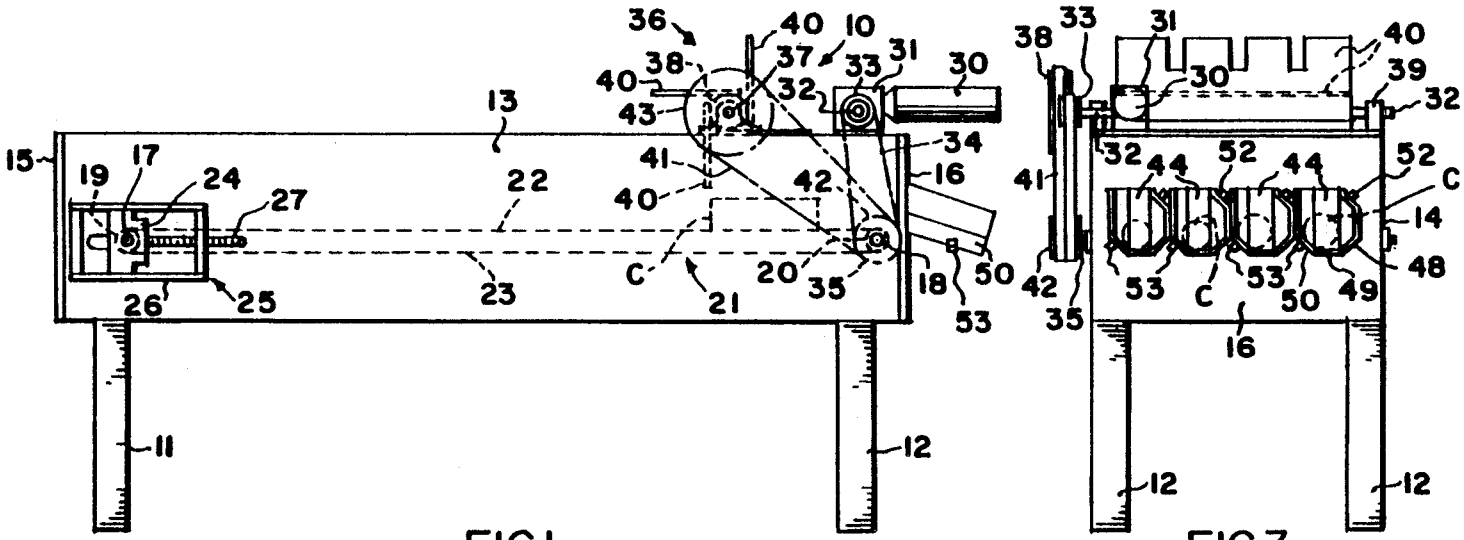
FIG.1
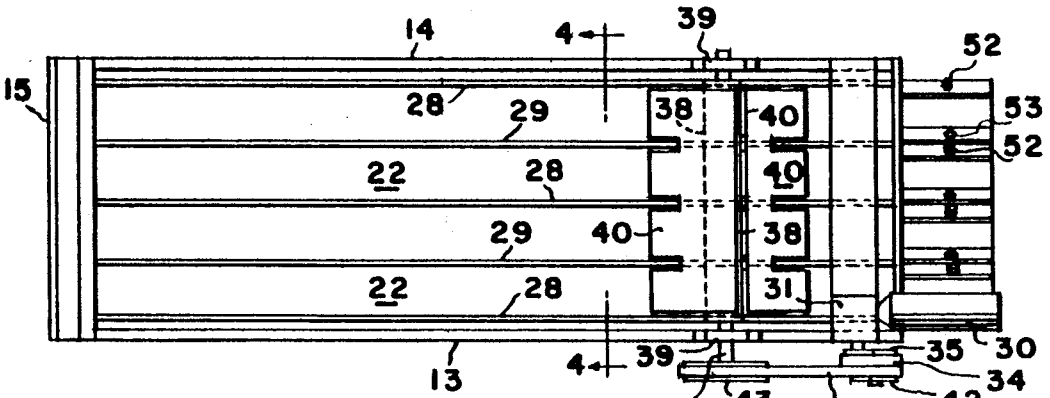
FIG.2
FIG.3
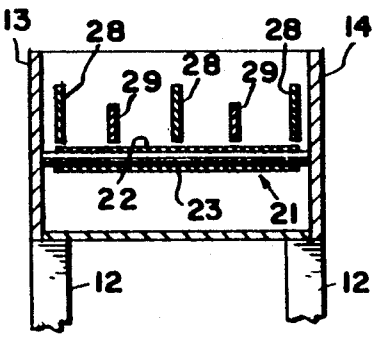
FIG.4

CONTAINER COUNTING APPARATUS

This invention relates to apparatus for counting containers and particularly containers which are wholly or partially transparent when empty.

BACKGROUND OF THE INVENTION

Consistent with the increasing trend toward recycling or various types of containers, such as aluminum and plastic containers, various forms of container counting apparatus are being utilized during the course of reclaiming such recycleable containers. Such counting apparatus is particularly useful in geographical areas where container vendors must refund previously collected deposits for each returned empty container. Under these circumstances the vendor may accumulate a large number of empty containers which are then sold to a reclaimer who crushes and bales or otherwise conditions the containers for subsequent handling.

At various stages of the foregoing procedures, it is necessary to provide some manner of ascertaining the total number of containers being processed. While various systems of counting containers are available, one such system advantageously utilizes apparatus which is capable of automatically counting containers in a continuous and effective manner. Such system is disclosed in U.S. Pat. No. 4,590,364, issued May 20, 1986. This apparatus includes a counting unit which is provided with a movable conveyor having a plurality of parallel and spaced partitions or dividers overlying such conveyor to provide a series of parallel pathways or lanes leading toward a discharge zone. A container metering device is provided upstream from the discharge zone and overlies the lanes and functions to preclude stacking of such containers so that no more than one container in any lane may pass the metering device at any one time.

A counting mechanism is provided at the discharge zone which functions to count and record the number of containers discharged from such zone. The use of photoelectric sensors is specifically disclosed in the aforesaid patent, such sensors being of the type which generate a counting pulse in a counting mechanism each time a light beam is established between the emitter and collector of each sensor.

Although the aforesaid container counting apparatus is highly efficient in the counting of opaque containers, it is not readily adaptable to the counting of different kinds of containers, particularly empty bottles formed of transparent plastic. Photoelectric counting means will not function efficiently with transparent plastic containers because the light beam is readily transmitted through the container. When confronted with a series of transparent containers, the photoelectric counting arrangement is incapable of distinguishing each individual container and the resultant total count is inaccurate.

Some plastic containers, usually in the form of bottles include opaque areas caused by labels or areas of different types of plastic. A photoelectric counting mechanism is incapable of accurately distinguishing one such container from another and, on occasion, the presence of a label or different kinds of plastic material may result in a photoelectric counting mechanism to provide a multiple count for a single container, thereby causing overall inaccuracy in the count.

SUMMARY OF THE INVENTION

The container counting apparatus of the invention is constructed very similarly to that disclosed in the aforesaid patent, but includes an improved form of counting mechanism utilizing sonic sensors mounted at the discharge zone and being capable of effectively counting any type of container, whether it is opaque, transparent, or partially opaque and partially transparent, in a highly accurate manner. Individual sonic sensor units are mounted in chute-like discharge members in the discharge zone of the apparatus, each sensor unit having a sonic emitter and a companion sonic receiver aligned relative to one another in such manner that each receiver can receive emissions from its companion emitter only, thereby avoiding any possibility that the receiver of any unit can be activated by the emitter of some other unit.

The improved container counting apparatus further includes the utilization of lane dividers positioned over the movable conveyor, adjacent ones of such dividers being of varying height upstream of the metering means. The variation in lane divider height prevents bridging of adjacent lanes by any container, whereas the metering means functions in the manner previously known to prevent stacking of such containers.

The container counting apparatus of the invention efficiently may be utilized in a system including a loading conveyor which delivers containers to the counting apparatus, as well as a hopper and a further conveyor for receiving counted containers from the discharge zone to deliver the containers to a crusher, baler or the like, all as is disclosed in the aforesaid patent.

THE DRAWINGS

A presently preferred embodiment of the invention is disclosed in the following description and in the accompanying drawings, in which:

FIG. 1 is a side elevational view of the container counting apparatus;

FIG. 2 is a top plan view of the counting apparatus;

FIG. 3 is an end elevational view of the counting apparatus; and

FIG. 4 is a sectional view taken along the line 4—4 of FIG. 2.

DETAILED DESCRIPTION

In view of the many similarities existing between the container counting apparatus of the invention and that disclosed in the U.S. Pat. No. 4,590,364, as well as the similarities existing with respect to the environment of use, the complete disclosure of the aforesaid patent is hereby incorporated in the present disclosure by reference.

Referring in particular to FIGS. 1-3, the container counting apparatus 10 of the present invention includes pairs of end supporting legs 11 and 12 which are members of a frame supporting side walls 13 and 14 and end walls 15 and 16. Spanning the side walls 13 and 14 and journaled in bearings supported thereby are rotary shafts 17 and 18 on which are fixed turning rolls 19 and 20 around which is trained an endless conveyor belt 21 having an upper run 22 and a lower run 23.

Preferably, the opposite ends of the shaft 17 of the turning roll 19 are journaled in reciprocable blocks 24 forming part of a tensioning device 25 having a frame 26 through which extends a threaded adjusting screw 27. Each block 24 is adjustable toward and away from the opposite turning roll 20 so as to provide more or less tension on the runs 22 and 23 of the conveyor belt 21.

The area above the upper run 22 of the conveyor belt 21 is divided into a series of container channels or lanes by a plurality of parallel and transversely spaced dividers or partitions 28 and 29. As best illustrated in FIG. 4, the lane dividers 28 are of greater height than the adjacent lane dividers 29. Varying the lane divider height, preferably in a uniform pattern as illustrated, prevents containers, and particularly round containers of cylindrical cross-section, from extending across or bridging the tops of two adjacent lane dividers. Although the variation in height need not necessarily conform to the alternating arrangement illustrated and described, and while the differences in height between adjacent lane dividers may vary, it has been found that the provision of such differences in height between adjacent lane dividers make it highly unlikely that any container delivered to the apparatus can bridge two adjacent lane dividers without eventually falling into one of the lanes.

The lane dividers 28 and 29 are spaced slightly above the upper run 22 of the conveyor belt 21 so as to maintain clearance therebetween. The lane dividers 28 and 29 are fixedly supported in the apparatus 10 by attachment at opposite ends thereof to the end walls 15 and 16.

The conveyor belt 21 is driven by an electric motor 30 coupled with a gear box 31 suitably mounted on the side wall 13. A drive shaft 32 of the gear box 31 is fixed to a drive pulley 33 which in turn is drivingly connected via a drive belt 34 to the conveyor belt drive pulley 35 fixed to the shaft 18. In this manner the conveyor belt 21 is driven in a clockwise direction as viewed in FIG. 1.

With the conveyor belt moving in a clockwise direction, the discharge end of the container counting apparatus 10 is located adjacent the end wall 16. Upstream from such discharge end is located a container metering mechanism 36. This metering mechanism spans the conveyor belt between the side walls 13 and 14 and includes a rotatable shaft 37 fixed to rotating body member 38 which extends transversely across the lane dividers 28 and 29 and above the upper level of such dividers. Opposite end of the shaft 37 are suitably mounted in journals 39 which in turn are mounted on the top surfaces of the side walls 13 and 14.

The container metering mechanism 36 further includes spaced apart sweeps or finger members 40 formed of rubber of rubbery material. The sweeps are fixed at their roots to the body member 38 and are arranged to project outwardly from the body member 38 in quadrants of 45°. The metering mechanism 36 is driven by a drive belt 41 which extends from a drive pulley 42 fixed on the outer end of the drive shaft 18 and is in driving engagement with a driven pulley 43 fixed on the outer end of the shaft 37.

The metering mechanism 36 is driven in a clockwise direction so that the sweeps or finger members 40 successively move downwardly and between the lane dividers 28 and 29 in a direction which is opposite to the direction of movement of the upper run 22 of the conveyor belt 21. The radial length of each sweep 40 is such that its free end, when closest to the upper run 22 of the conveyor belt, is at a level which just clears a single container C lying on the conveyor. However, should another container be stacked upon the container in engagement with the conveyor, the sweep will displace the stacked container rearwardly, i.e., opposite the direction of movement of the conveyor, thereby precluding more than a single container from any lane entering the discharge zone at one time.

The sweeps 40 of the metering device 36 may be in the form of rubber or rubbery flaps. The use of such flaps results in noise reduction. While the sweeps 40 are illustrated as being spaced by slots, the slots could be eliminated and the free ends of the sweeps configured to avoid interference with the different height lane dividers. The speed of rotation of the metering mechanism 36 is so regulated with respect to the speed of the conveyor belt 21 that no container may pass the mechanism 36 without being exposed to engagement by a sweep 40 in the event such container lies in the path of movement of the sweep's free end. Additionally, a second metering device 36 may be located upstream of the metering device illustrated if desired.

The end wall 16 of the apparatus 10 defines the beginning of a container discharge zone. The wall 16, as best illustrated in FIG. 3, includes a series of openings 44 arranged in side by side relation across the end wall 16 between the side walls 13 and 14. The discharge openings 44 are aligned with the lanes defined by the divider walls 28 and 29 as best illustrated in FIG. 2. If desired, the openings 44 may be in the form of an elongated slot.

In communication with each opening 44 is a container discharge chute generally designated by the numeral 45. Each chute 45 constitutes a container discharge means which is in the form of a channel being downwardly inclined relative to the lanes defined by the lane dividers 28 and 29, such inclination being best illustrated in FIG. 1.

Each chute 45 is formed from a series of angularly arranged flat surface portions 46–50 which collectively extend circumferentially to contain and control the sliding movement of a container C therethrough during a discharge operation. The flat surface portions 46 and 50 of each chute 45 are diametrically opposed. Each flat surface portion 46 carries a sonic emitter 52 diametrically opposed to and aligned with a companion sonic receiver 53, each companion emitter and sensor constituting a sonic sensor unit independent of the others.

The spacing between the companion sonic emitters 52 and receivers 53 in each chute 45 is such that the passage of a container C through a chute 45 interrupts the transmission of sound between the emitter and the receiver. Additionally, each sonic sensor unit is arranged at an angular relationship to the horizontal to avoid linearity between adjacent sonic sensor units. Such angular relationship preferably is on the order of 40° to 50° to a horizontal plane. In this manner the emissions of one sonic emitter can be received by its companion receiver only. Suitable sonic sensor units are commercially available and may be obtained from Migatron Corporation, LaGrange, Ill., for example.

The sonic sensor units are suitably connected to a known form of counting mechanism (not shown), such as of the type referred to in the aforesaid U.S. Pat. No. 4,590,364.

In the operation of the apparatus, the passage of a container C through a discharge chute 45 will interrupt the transmission of sonic energy between the companion emitter 52 and receiver 53 of the sensor unit associated with such chute. Once the container C has passed from between the companion emitter and receiver, such transmission will be reestablished between the emitter 52 and the companion receiver 53. Such reestablishment causes the counting mechanism to index and thus record the passage of a single container.

The downward slope of the discharge chutes 45 causes each container C to tilt as it progresses through and leaves each opening 44. Such tilting or tipping of each container creates a gap between the tilted container and any following container. This gap remains present as the leading container slides downwardly through a discharge chute 45 and the following container emerges from the opening 44 in horizontal condition. As each container C passing through a discharge chute 45 interrupts sonic energy reception by the receiver of the sonic sensor unit associated with such chute, the presence of the gap following the emerging container will reestablish sound transmission causing the counting mechanism to be indexed.

The disclosed embodiment is representative of a presently preferred form of the invention, but is intended to be illustrative rather than definitive thereof. The invention is defined in the claims.

What is claimed is:

1. Apparatus for use in counting containers of cylindrical cross-section, said apparatus comprising conveyor means for supporting and moving containers along a path in a direction toward a discharge zone; a plurality of spaced divider means overlying said conveyor means and defining adjacent lanes extending in said direction for guiding containers moving toward said discharge zone, adjacent ones of said divider means being of different height to minimize container bridging of said lanes; metering means overlying said lanes upstream of said discharge zone and including sweep means spanning said lanes at such height as to preclude container stacking on said conveyor means; and sensing means at said discharge zone in the path of movement of said containers for sensing each container passing said discharge zone.

2. The apparatus of claim 1 wherein said discharge zone includes chute-like discharge means aligned with said lanes to receive containers therefrom, said sensing means including a sonic energy emitter and a sonic energy receiver for receiving sonic energy emitted by said emitter.

3. The apparatus of claim 2 wherein each of said discharge means comprises a channel, said channel of each of said discharge means being inclined downwardly relative to said lanes to enable containers discharged from said lanes to tip and create a gap between leading and following containers, said sensor means being positioned in alignment with each such gap and including a sonic emitter for emitting a sonic beam and a sonic receiver for receiving said beam, said emitter and said receiver being on opposite sides of each of said channels and at different levels whereby said beam is inclined relative to said path.

4. The apparatus of claim 1 wherein said divider means are alternately of greater and lesser height.

5. The apparatus of claim 1 wherein said sweep means includes rotatable support means overlying said conveyor means for supporting a series of circumferentially arranged fingers, said fingers being mounted on said support means and projecting radially outwardly therefrom.

6. The apparatus of claim 5 including means for rotating said sweep means in a direction opposite to the direction of movement of containers on said conveyor means.

7. The apparatus of claim 5 wherein said fingers are separated from one another by slots each of which is of such width as to accommodate one of said divider means.

8. Apparatus for use in counting containers of cylindrical cross-section, said apparatus comprising conveyor means for supporting and moving containers in a direction toward a discharge zone; a plurality of spaced divider means overlying said conveyor means and defining adjacent lanes extending in said direction, adjacent ones of said divider means being of different height relative to said conveyor means to minimize container bridging of said lanes; and sensing means for sensing each container passing said discharge zone.

9. Apparatus for use in counting empty containers of cylindrical cross section, said apparatus comprising conveyor means for supporting and moving said containers in a direction toward a discharge zone; divider means forming a plurality of lanes above said conveyor means and leading to said discharge zone for guiding containers moving toward said discharge zone; and sonic sensor means for each lane for sensing passage of each container through each of said lanes at said discharge zone, the sonic sensor means for each lane comprising a sonic emitter and a companion sonic receiver straddling said lane to enable a sonic beam to traverse said lane along a linear path so positioned that the sonic beam emitted by any one of said emitter can be received only by an associated companion receiver for each of said lanes.

10. The apparatus of claim 9 wherein said discharge zone is formed by chutes inclined downwardly to cause containers delivered thereto to tip and create a gap between leading and following containers, the emitter and receiver of each of said sensor means being so positioned that the sonic beam emitted by each emitter is aligned with each such gap.

11. The apparatus of claim 10 wherein each of said chutes is formed with a series of angularly arranged flat surface portions which collectively extend circumferentially to place a pair of said flat surface portions in diametrically opposed relation at an angle of from 40° to 50° relative to a horizontal plane, said sonic emitter and said sonic receiver being mounted on said opposed flat surface portions.

12. Apparatus for use in counting containers, said apparatus comprising conveyor means for supporting and moving containers in a direction toward a discharge zone; a plurality of spaced divider means overlying said conveyor means and defining a plurality of adjacent lanes for guiding said containers; and sensing means at said discharge zone for sensing containers passing through said discharge zone, said sensing means comprising a plurality of pairs of sonic emitters and companion sonic receivers corresponding in number to the plurality of said lanes, each of said sonic emitters being operable to emit a sonic beam along a linear path for reception by the companion sonic receivers, each of said sonic emitters and companion sonic receivers of said pairs being spaced apart a distance sufficient to enable a container moving through said discharge zone to pass between said emitter and said companion receiver and interrupt the sonic beam therebetween, each pair of said emitters and companion receivers being so arranged that the path of the sonic beam emitted by each of said emitters is in such direction that said beams can be received by the companion receivers only.

13. The apparatus of claim 12, wherein the path of said sonic beam is inclined to a horizontal plane.

* * * * *